US006402298B1

(12) United States Patent
Nanjo et al.

(10) Patent No.: US 6,402,298 B1
(45) Date of Patent: Jun. 11, 2002

(54) INK TANK MODULE, INK TANK COUPLING MEMBER, AND INKJET RECORDING APPARATUS

(75) Inventors: Tatsuo Nanjo, Kanagawa; Shozo Hattori, Tokyo; Hajime Yamamoto, Kanagawa; Eiichiro Shimizu, Kanagawa; Hiroshi Koshikawa, Kanagawa; Hiroki Hayashi, Kanagawa; Kenji Kitabatake, Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/956,022

(22) Filed: Sep. 20, 2001

(30) Foreign Application Priority Data

Oct. 4, 2000 (JP) ..... 2000-305265

(51) Int. Cl.[7] ..... B41J 2/175
(52) U.S. Cl. ..... 347/49; 347/86
(58) Field of Search ..... 347/49, 85, 86, 347/87; 401/34

(56) References Cited

U.S. PATENT DOCUMENTS 5,044,804 A * 9/1991 Chuang ..... 401/34
5,148,194 A * 9/1992 Asai et al. ..... 347/49
6,267,475 B1 * 7/2001 Lee et al. ..... 347/86

* cited by examiner

*Primary Examiner*—Anh T. N. Vo
(74) *Attorney, Agent, or Firm*—Fitzpatrick, Cella, Harper & Scinto

(57) ABSTRACT

An ink tank module used for an inkjet recording apparatus includes a plurality of ink tanks having substantially the same outside shape and integrated by being coupled together, wherein each of the plurality of ink tanks includes an ink accommodating section for accommodating ink and a supply port for supplying the ink to an inkjet recording head, the plurality of ink tanks are disposed so that the supply ports are disposed on the same surface and include a coupling member interposed therebetween and an annular film member for covering the plurality of ink tanks and the coupling member, and the ink tank module can integrally be mounted and dismounted on and from a holder on which the inkjet recording head is mounted. With this arrangement, since the ink tank module is arranged using the ink tanks, it is not necessary to separately design and manufacture an ink tank of a large capacity used for black ink which is consumed in a large amount, whereby the ink tank can be easily manufactured and the cost thereof can be reduced.

12 Claims, 15 Drawing Sheets

INK TANK MODULE, INK TANK COUPLING MEMBER, AND INKJET RECORDING APPARATUS

FIELD OF THE INVENTION

The present invention relates to an ink tank module, an ink tank coupling member, and an inkjet recording apparatus including them. More specifically, the present invention concerns an ink tank module in which a plurality of ink tanks are coupled together and arranged as a module The present invention also concerns an ink tank coupling member for firmly coupling a plurality of ink tanks and enabling them to be joined to an inkjet recording head or to the joint of a subtank with pinpoint positional accuracy. Additionally, the present invention concerns an inkjet recording apparatus including the ink tank module with the ink tank coupling member.

DESCRIPTION OF THE RELATED ART

An inkjet recording apparatus, which is a so-called non-impact type recording apparatus, has been widely used because the apparatus can advantageously perform high speed recording as well as recording on various types of recording media while causing little or no noise during recording. This type of inkjet recording apparatus records on a recording medium by ejecting fine droplets of ink from a minute ejection port, and generally includes an inkjet recording nozzle for ejecting droplets of ink and an ink supply system for supplying ink to the nozzle. There is known, as an example of an ink ejecting system of an inkjet recording apparatus, a bubble jet system which is arranged such that an electrothermal conversion element is disposed in a recording liquid chamber. The electrothermal conversion element is supplied with an electric pulse, acting as a recording signal, and heated thereby so that thermal energy is applied to ink and droplets of ink are ejected by the bubble pressure of the ink when the ink is heated (film boiling). The recording apparatus, including this type of the inkjet recording head, can output characters and images of a high quality at a low cost. The inkjet recording apparatus is generally arranged to provide for recording in color by the provision of independent ejection mechanisms, to which black ink and color inks of cyan, magenta, and yellow are supplied.

An inkjet recording apparatus that is capable of recording in color generally uses a single ink tank. That is, the inks of the respective colors (black, cyan, magenta, and yellow) are each accommodated in the same type of ink tank, and these ink tanks are mounted on the recording apparatus. This is for the purpose of reducing manufacturing costs by simplifying the manufacturing process. The cost reduction is realized by designing and evaluating a single type of ink tank and its mounting mechanism and using that type of ink tank for all the respective colors.

However, the inks of the respective colors used in an inkjet recording apparatus may have different consumption speeds depending on the content to be recorded. Specifically, black ink typically has a higher consumption speed than the respective color inks of cyan, magenta, and yellow because texts, generally recorded with black ink, are more frequently printed than graphics. When the same type of ink tank is used regardless of the colors and types of inks as described above, the black ink tank is replaced sooner as well as more often than the color ink tanks because the amount of ink in all the ink tank is initially the same. Thus, a problem arises in that it is not convenient from a use's point of view to use the same type of ink tank for all of the respective colors.

In contrast, there is also an arrangement in which only the black ink, which typically has a higher consumption speed, is accommodated in an ink tank which is designed separately from the color ink tanks and is several times larger than the color ink tanks. In this case, these ink tanks are more convenient from the point of view users because a larger quantity of black ink is provided in the larger ink tank, thereby reducing the frequency of ink tank replacement. With this arrangement, however, manufacturing costs may increase because design and evaluation must be performed for both the standard ink tank and the large capacity ink tank.

SUMMARY OF THE INVENTION

In view of these problems, it is an object of the present invention to provide an ink tank module that has an ink capacity larger than a standard ink tank which can be formed by securely coupling a plurality of standard ink tanks together. Accordingly, only a single type of ink tank need be designed and tested, thereby manufacturing costs are reduced. Another object of the present invention is to provide an inkjet recording apparatus that can be easily used by a user without requiring frequent replacement of ink tanks and without complicating design and manufacturing processes.

To solve the aforementioned problems, an ink tank module of the present invention includes a plurality of ink tanks having substantially the same outside shape and integrated by being coupled with each other, wherein each of the plurality of ink tanks includes an ink accommodating section for accommodating ink and a supply port for supplying the ink to an inkjet recording head, the plurality of ink tanks are disposed so that the supply ports are disposed on the same surface and include a coupling member interposed therebetween and an annular film member for covering the plurality of ink tanks and the coupling member, and the ink tank module can integrally be mounted and dismounted on and from a holder on which the inkjet recording head is mounted.

Further, in an ink tank coupling member of the present invention for arranging an ink tank module in which a plurality of ink tanks each accommodating ink and having a supply port for supplying the ink to an inkjet recording head are coupled with each other and which can be integrally mounted and dismounted on and from a holder on which an inkjet recording head is mounted, the ink tank coupling member is interposed between the ink tanks that are disposed adjacent to each other so as to fix the plurality of ink tanks in such a positional relationship that the supply ports are disposed at the same pitch as the joint pitch of the holder.

An inkjet recording apparatus of the present invention includes a holder having an inkjet recording head mounted thereon for ejecting ink, the aforementioned ink tank module, and ink tanks as single bodies constituting the module, wherein the holder includes ink tank holding sections on and from which the ink tank module and the ink tank as the single bodies can be mounted and dismounted, respectively.

Further objects, features and advantages of the present invention will become apparent from the following detailed description of the preferred embodiments with reference to the attached drawings.

DESCRIPTION OF THE PREFERRED EMBODIMENTS

Preferred embodiments of the present invention will be described below with reference to the drawings.

[First embodiment]

Figure 1A:
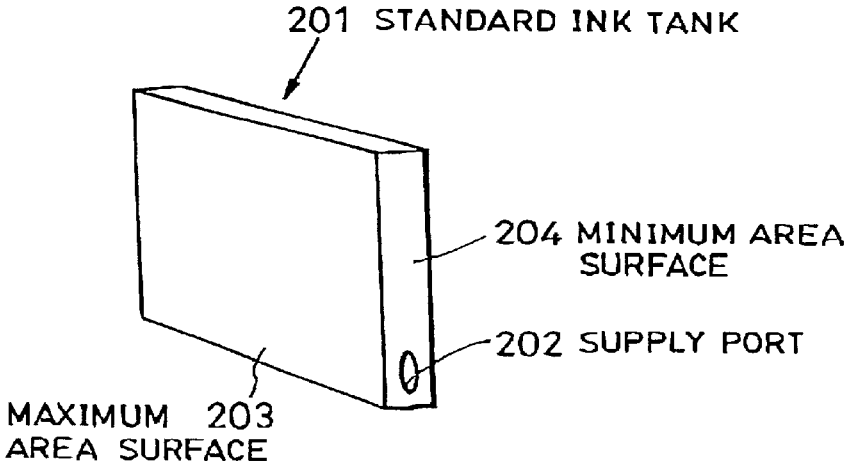
FIG. 1A is a schematic view of a standard ink tank of a first embodiment of the present invention.
Figure 1B:
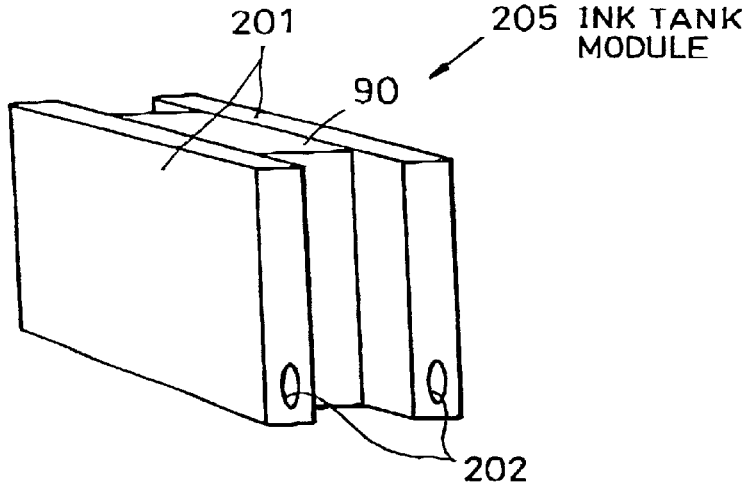
FIG. 1B is a schematic view of an ink tank module in which two sets of the standard ink tanks are coupled together.

First, an ink tank module of the present invention will be conceptually explained. FIG. 1A shows a schematic view of a standard ink tank 201 used in the first embodiment. FIG. 1B shows a schematic view of an ink tank module 205, in which two of the standard ink tanks 201 are coupled together and integrated into the ink tank module 205.

The standard ink tank 201 shown in FIG. 1A is formed in an approximately rectangular prism shape with height×width×depth of 25×10×40 (mm). However, the dimensions of the standard ink tank 201 are not limited to these measures. A supply port 202 is formed through one of the minimum area surfaces 204 of the four surfaces sandwiched between a pair of opposing maximum area surfaces 203. Color (cyan, magenta, and yellow) inks are generally accommodated in the standard ink tanks 201. The ink tank module 205 shown in FIG. 1B is arranged by coupling two of the standard ink tanks 201 together using an ink tank coupling member 90. Supply ports 202 are disposed side by side in the vicinities of the bottoms of the standard ink tanks 201. The ink tank module 205 has an ink capacity twice as large as that of the standard ink tank 201 and is also called a large capacity ink tank. Black ink is generally accommodated in the ink tank module 205.

Figure 2B:
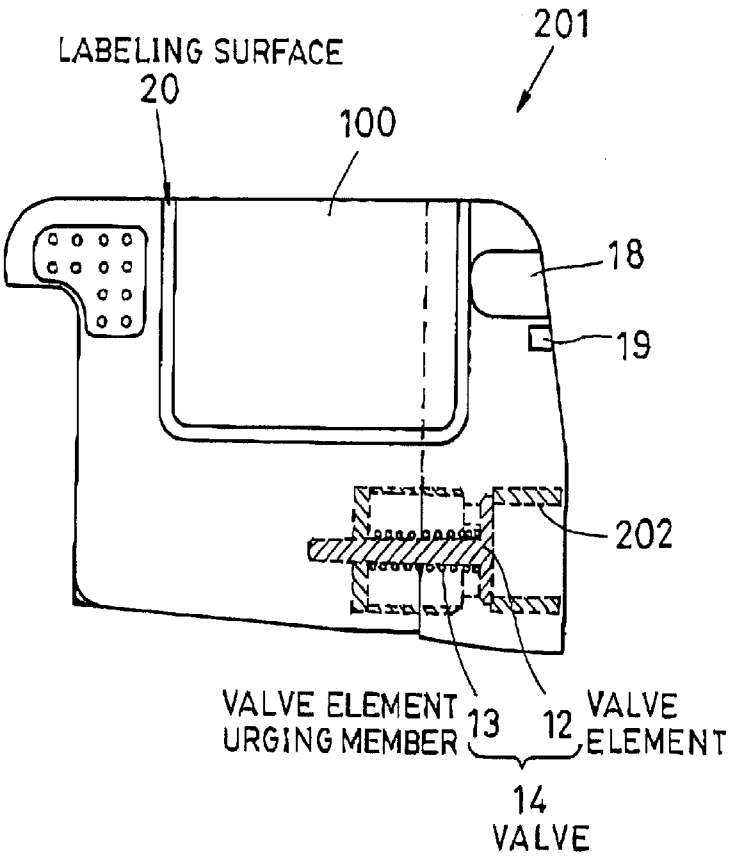
FIG. 2B is a side elevational view of the standard ink tank.
Figure 2A:
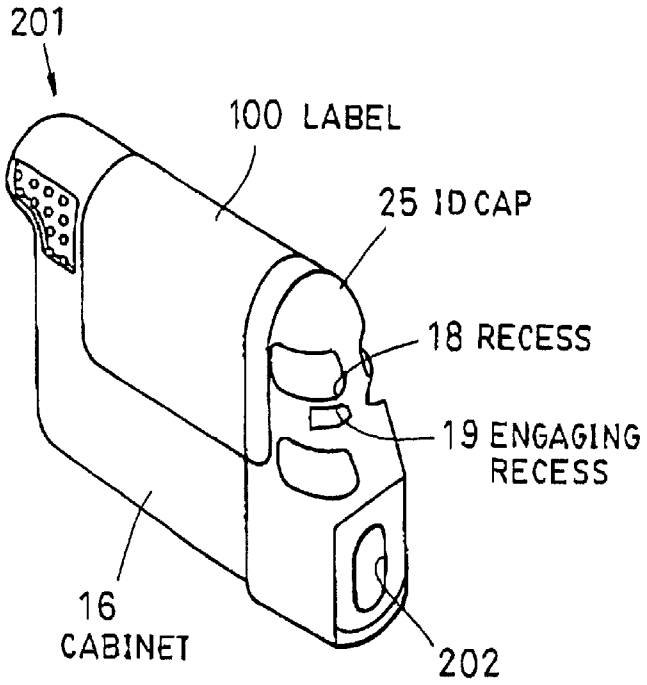
FIG. 2A is a detailed perspective view of the standard ink tank of the first embodiment.

FIG. 2A shows a detailed perspective view of the standard ink tank 201, and FIG. 2B shows a side elevational view thereof. The standard ink tank 201 is mainly composed of a cabinet 16, an ID cap 25, and a valve 14. The valve 14 is composed of a valve element 12 and a valve element urging member 13. The valve 14 is disposed to the supply port 202 for supplying ink to a joint 51 (refer to FIGS. 4 to 8) of the holder 30 of the main body of an inkjet recording apparatus. The ink is accommodated in a hermetically sealed space composed of the cabinet 16 and the valve 14, and the supply of ink is controlled by opening and closing the valve 14.

Figure 3:
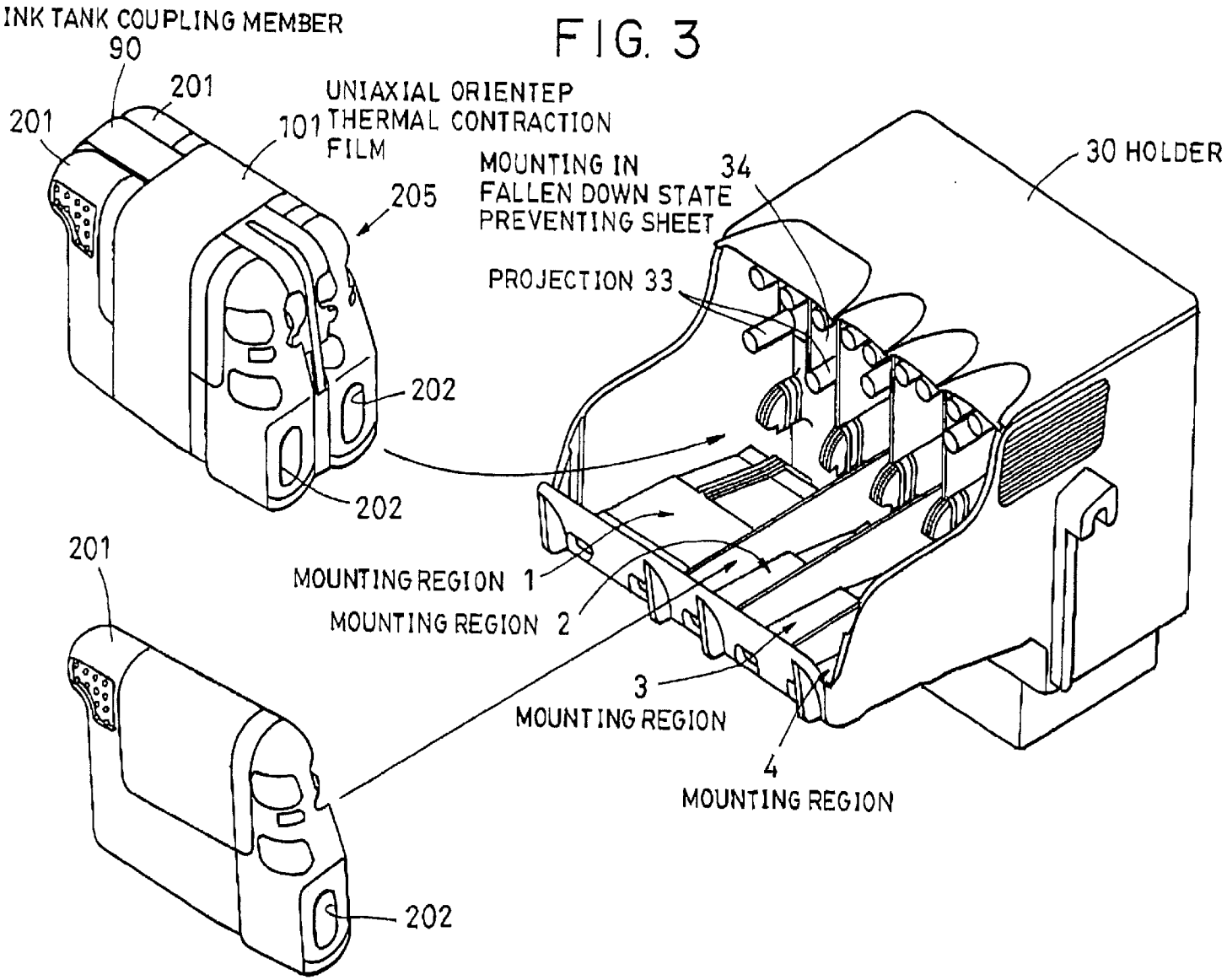
FIG. 3 is a perspective view showing a holder, the standard ink tank mounted thereon, and an ink tank module.

The ID cap 25 is formed in a shape for covering the front surface of the cabinet 16, and the supply port 202 is formed through the cabinet 16 and the ID cap 25. A pair of recesses 18 are formed in the ID cap 25 at positions above the supply port 202 so as to be fitted to a pair of projections 33 (engaging sections) disposed in the holder 30 as shown in FIG. 3. The holder 30 has mounting regions 1 to 4 where the standard ink tanks 201 of the respective colors are mounted, and pairs of projections 33, each having a pattern unique to each of the mounting regions 1 to 4, are disposed in the holder 30. That is, a pair of recesses 18, which can be fitted to (engaged with) a pair of projections 33 corresponding to the pair of recesses 18, are formed in each of the standard ink tanks 201 which are to be inserted into the respective mounting regions 1 to 4. Accordingly, when it is intended to mount an ink tank suitable for a particular mounting region, the pair of projections 33 of the particular mounting region is fitted to the pair of recesses 18 of the ID cap 25 of the ink tank because the pattern of the projections 33 corresponds to that of the recesses 18. Whereas, when it is intended to mount an ink tank which is not suitable for a particular mounting region, the pair of recesses 18 of the ink tank cannot be fitted to or engaged with the pair of the projections 33 of the particular mounting region because the pattern of the recesses 18 is different from that of the projections 33. Thus, it is difficult to mount an ink tank in an incorrect mounting region. As described above, the ID cap 25 having the pair of recesses 18 acts as an erroneous insertion preventing member.

The ID cap 25 has a pair of engaging recesses 19, which are formed in the vicinity of the recesses 18, so as to be engaged with the projection 91 of the ink tank coupling member 90 which will be described later.

The standard ink tank 201 includes a labeling surface 20 on which a label 100 is stuck. The label 100 is stuck on the labeling surface 20 so as to extend over the cabinet 16 and the ID cap 25 and performs a role of preventing the ID cap 25 from separating from the standard ink tank 201.

Figure 4:
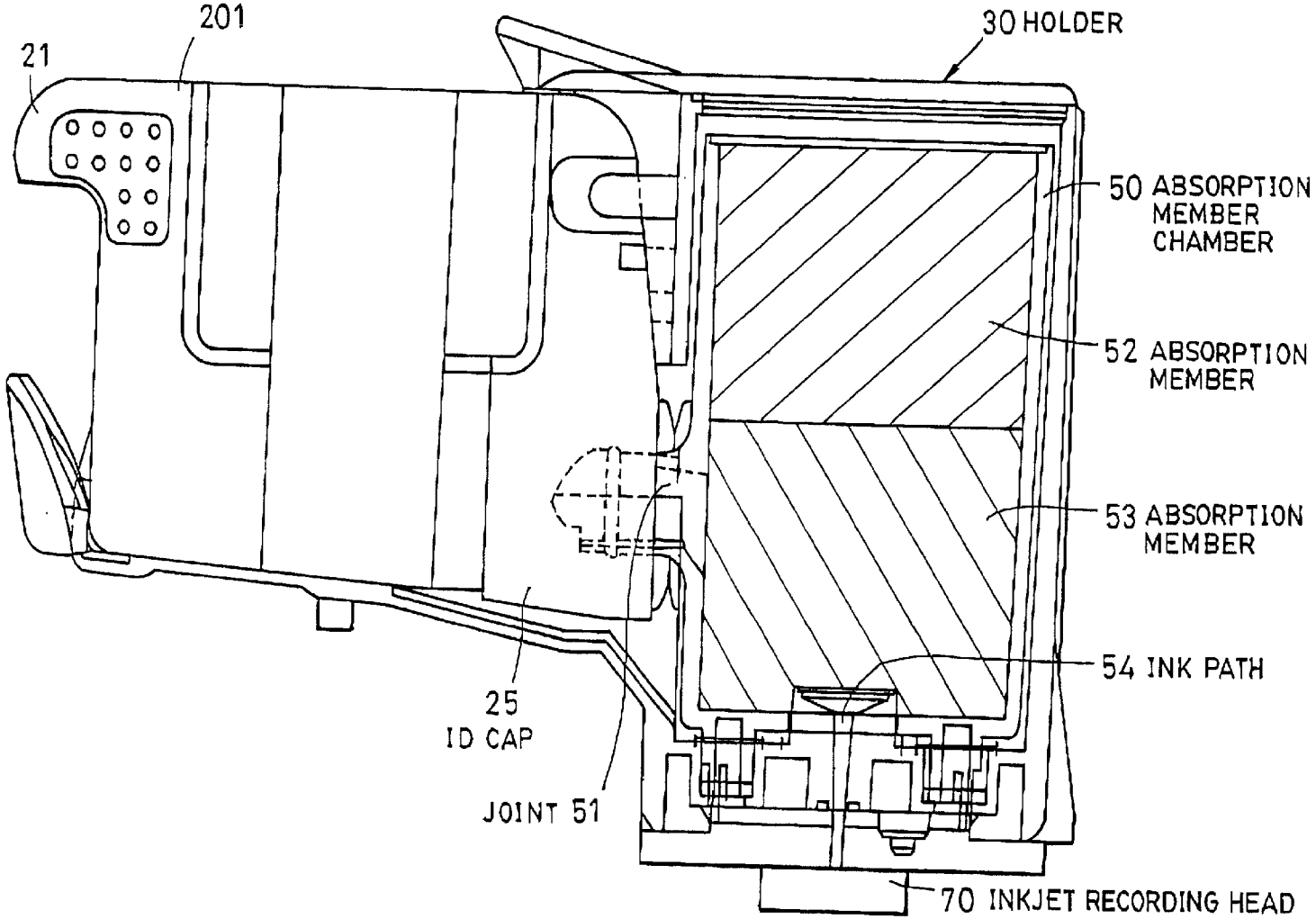
FIG. 4 is a side elevational view showing the outline of the holder on which the standard ink tank is mounted.

FIG. 4 is a side elevational view showing the outline of the holder 30 of the inkjet recording apparatus in a state in which a standard ink tank 201 of the present invention is mounted. Mounted on the holder 30 are an absorption member chamber 50 and an inkjet recording head 70. The absorption member chamber 50 contains absorption members 52 and 53 and includes the joint 51 and an atmosphere communication port (not shown). Further, an inkjet recording head 70 is positioned on a straight line connecting the center of the absorption member chamber 50 and the center of the holder 30. The standard ink tank 201 can be mounted and dismounted to and from the holder 30 so as to receive the joint 51 of the absorption member chamber 50 therein (FIG. 4 shows a mounted state). With this arrangement, the ink in the standard ink tank 201 penetrates the absorption member chamber 50 through the joint 51, penetrates the inkjet recording head 70 from the absorption members 52 and 53 through an ink flow path 54 in response to a request from the inkjet recording head 70, and is ejected from the inkjet recording head 70 by a method such as a bubble jet recording method, whereby an image and the like are recorded on a recording medium (not shown).

FIG. 3 is a perspective view showing the holder 30, and the standard ink tank 201 and the ink tank module 205. In this embodiment, the ink tank module 205 acting as the large capacity ink tank accommodating black ink is mounted on the mounting region 1 of the holder 30, the standard ink tank 201 accommodating cyan ink is mounted on the mounting region 2, the standard ink tank 201 accommodating magenta ink is mounted on the mounting region 3, and the standard ink tank 201 accommodating yellow ink is mounted on the mounting region 4. The ink tank module (large capacity ink tank) 205 is arranged by coupling two sets of the standard ink tanks 201 together with an ink tank coupling member 90.

FIGS. 5 to 8 sequentially show processes for mounting a standard ink tank 201 on the holder 30. The vicinity of the supply port 202 of the standard ink tank 201 is shown in detail so that the processes can be understood in detail, and portions other than the supply port 202 are shown in a partly simplified fashion.

Figure 5:
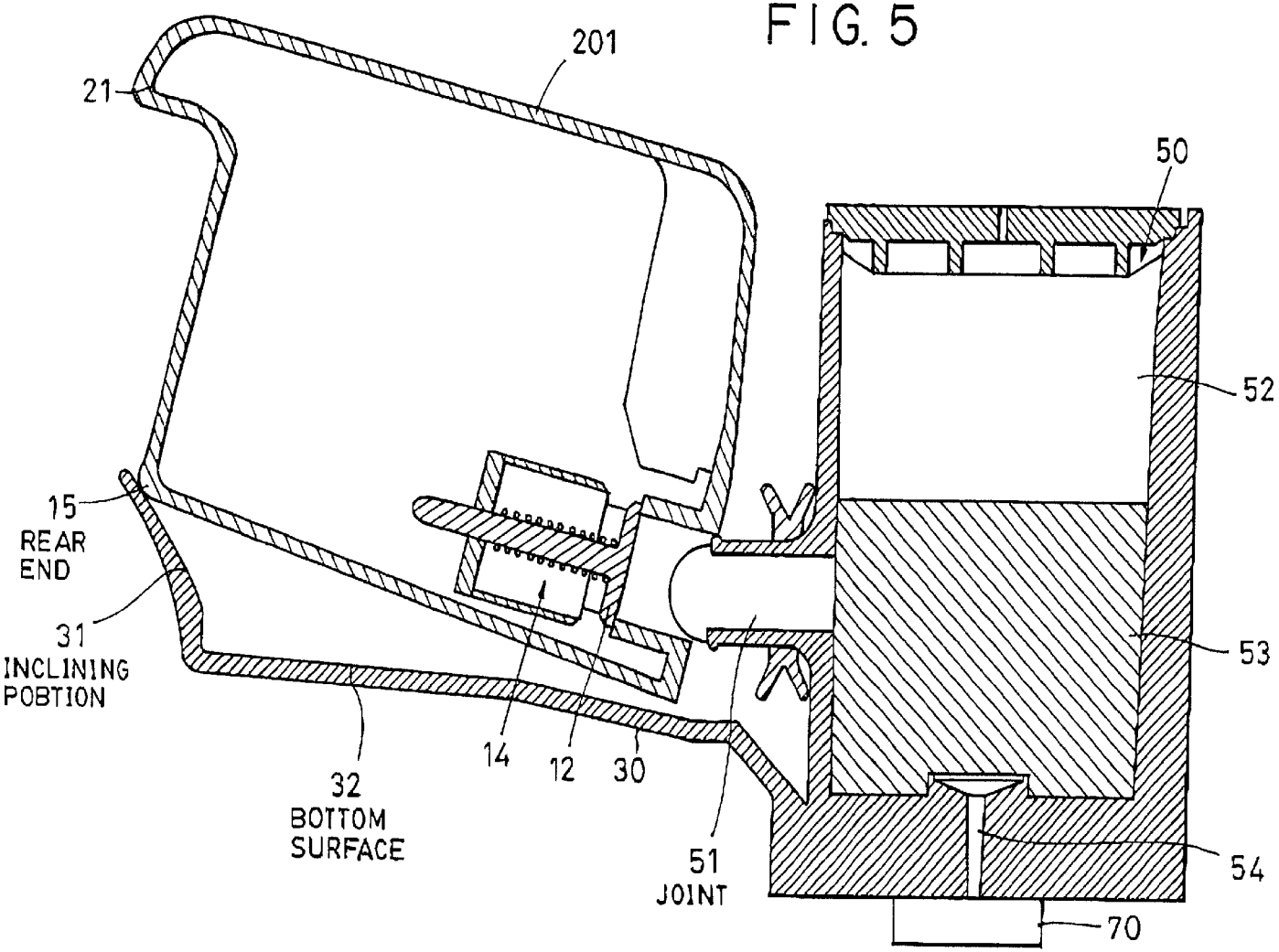
FIG. 5 is a view explaining a first step for mounting the standard ink tank on the holder.

FIG. 5 shows an initial state of the standard ink tank 201 in which the joint 51 of the holder 30 is inserted into the valve 14 of the standard ink tank 201

Figure 6:
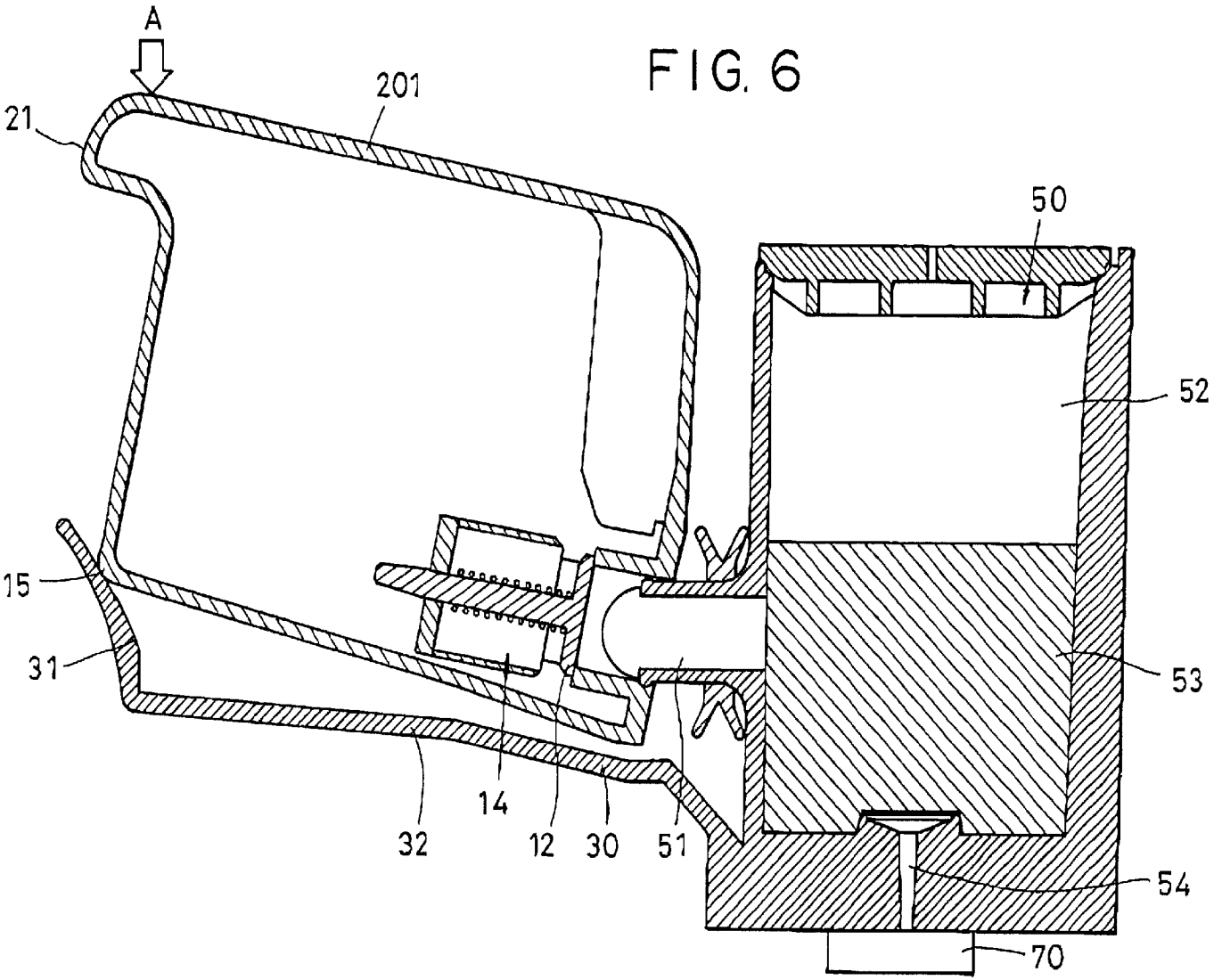
FIG. 6 is a view explaining a second step for mounting the standard ink tank on the holder.

Subsequently, when the standard ink tank 201 is pushed further in the direction of arrow A as shown in FIG. 6, the standard ink tank 201 slides down along an inclining section 31 at the rear end of the holder 30 while swinging about the center of the portion where the valve element 12 is coupled with the joint 51.

Figure 7:
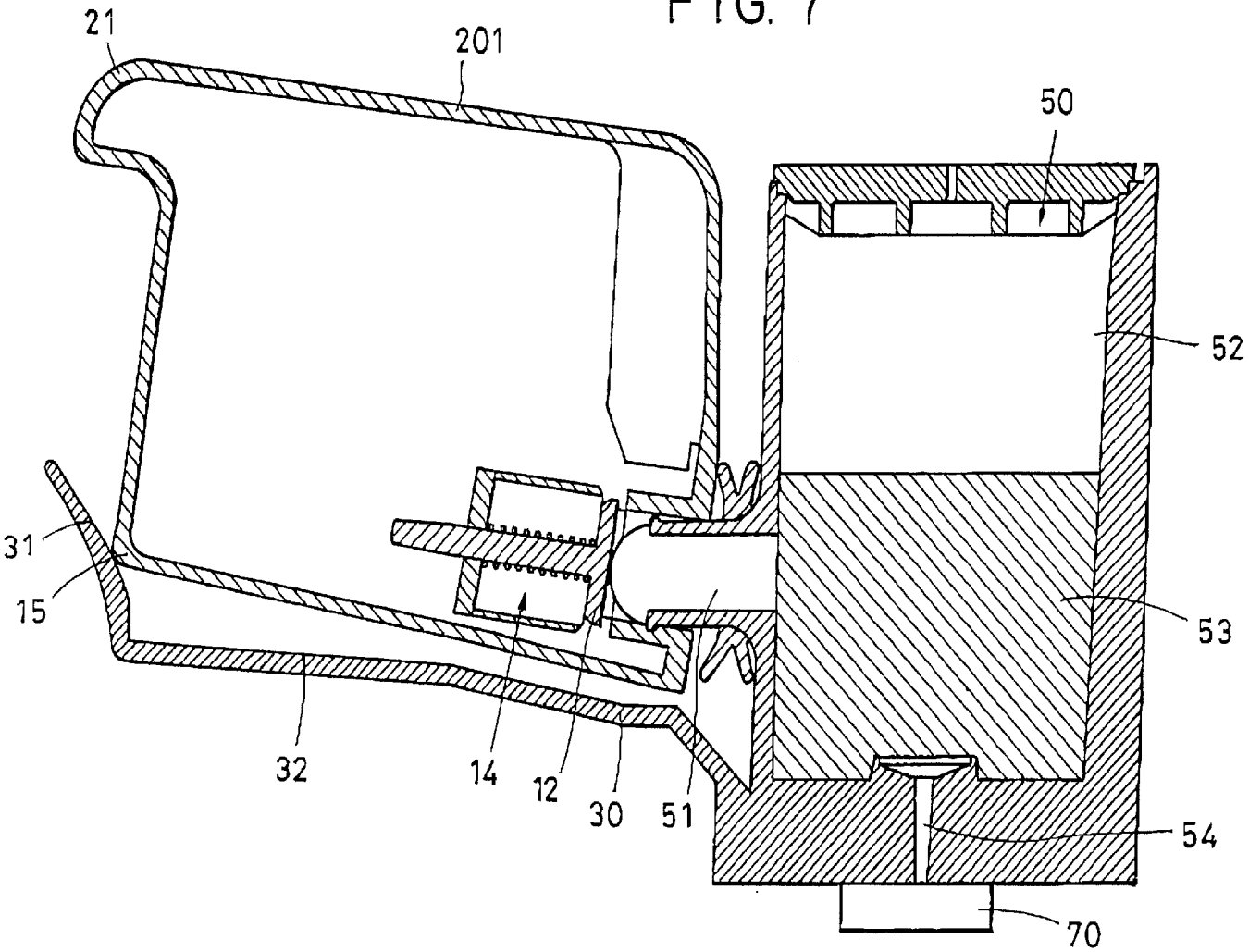
FIG. 7 is a view explaining a third step for mounting the standard ink tank on the holder.

As shown in FIG. 7, as the standard ink tank 201 slides into the holder 30, the valve 14 begins to open, and ink starts to be supplied to the holder 30.

Figure 8:
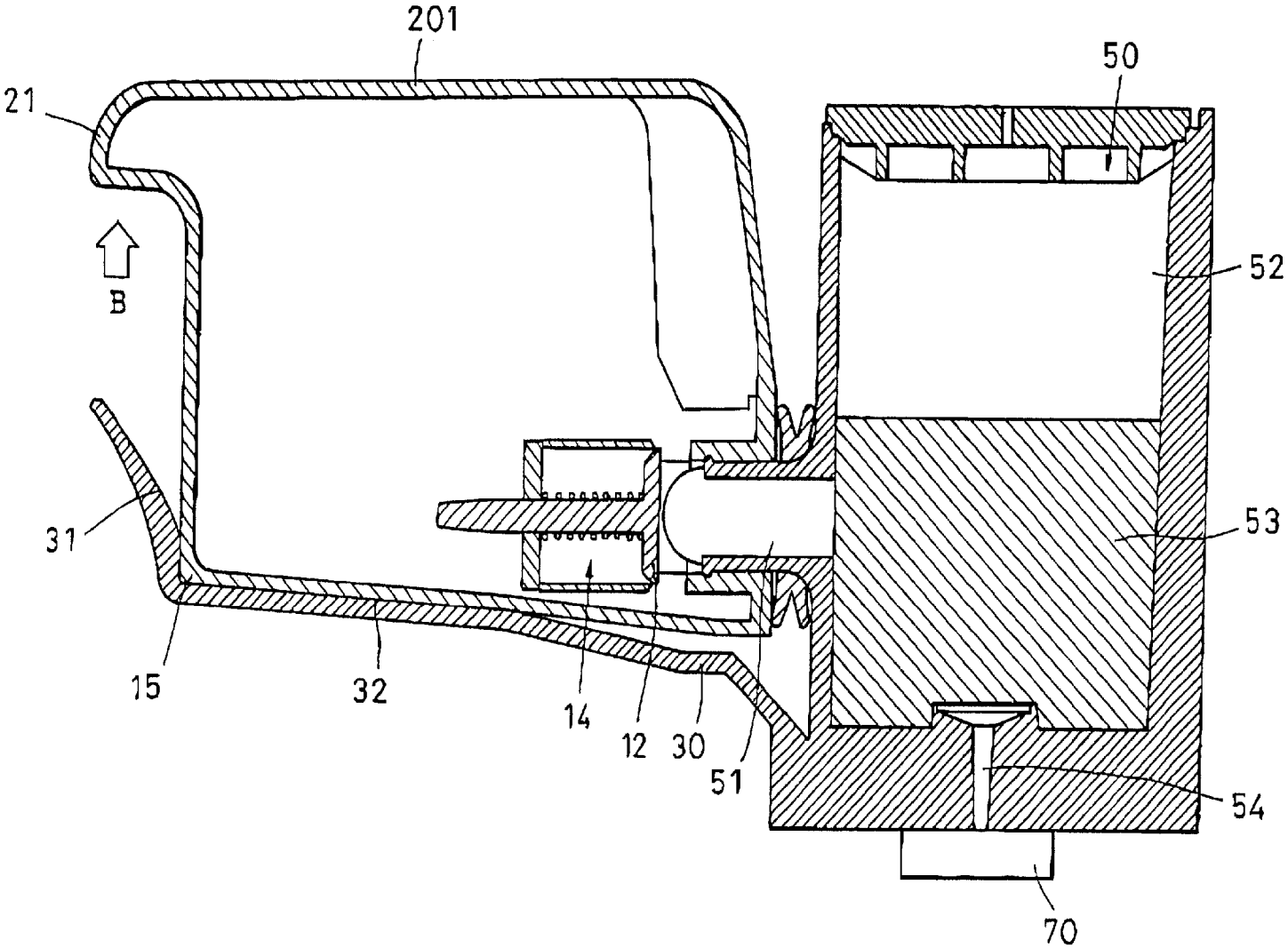
FIG. 8 is a view explaining a fourth step for mounting the standard ink tank on the holder.

As shown in FIG. 8, the rear end 15 of the standard ink tank 201 slides on the inclining section 31 at the rear end of the holder 30 and reaches the bottom 32 of the holder 30, whereby mounting of the standard ink tank 201 is finished.

To remove the standard ink tank 201, a grip section 21 is pushed upward in the direction of arrow B in FIG. 8, so as to lift the rear end 15 of the standard ink tank 201 upward. The standard ink tank 201 is also pushed out rearward by a repulsive force generated by valve 14 closing. In this manner, the standard ink tank 201 is removed from the holder 30 and joints 51.

Note that the mounting/dismounting method described above is applied in a similar manner to the large capacity tank (ink tank module 205) in addition to the standard ink tank 201.

Figure 9:
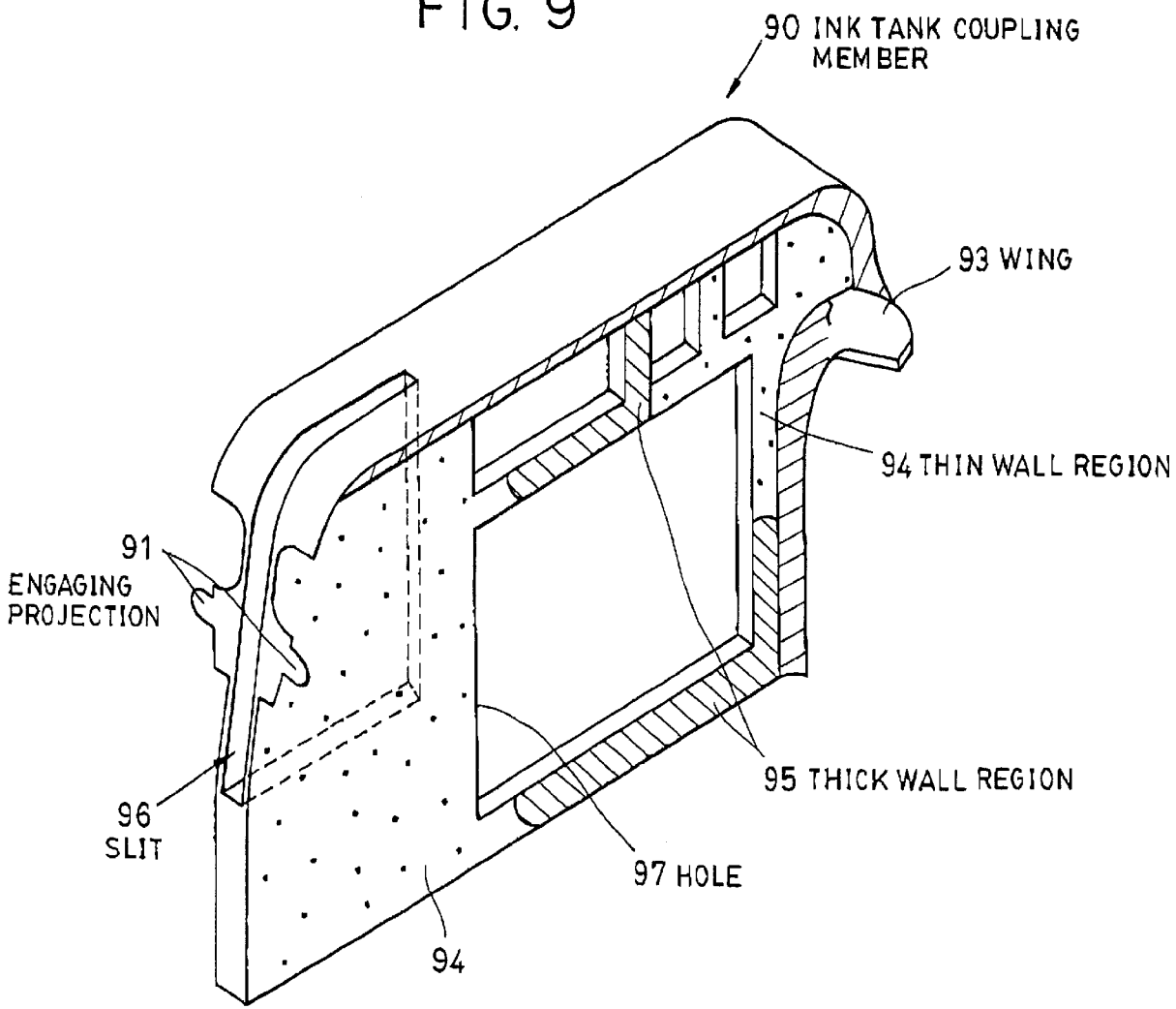
FIG. 9 is a perspective view of an ink tank coupling member.

FIG. 9 is a perspective view of the ink tank coupling member 90. The peripheral edge of the ink tank coupling member 90 is formed in a shape which is similar to that of the peripheral edge of the standard ink tank 201 so that a pair of standard ink tanks 201 can be mounted to both the sides of the ink tank coupling member 90 and be coupled together.

A hole 97 (through region without a wall) is formed through the ink tank coupling member 90 at a position near to the center thereof. The hole 97 is formed as a countermeasure for a sink mark formed in molding. Each corner of the upper and back surfaces of the ink tank coupling member 90 is continuously formed as a curved surface having a given curvature. Engaging projections 91 are formed in the vicinity of the front surface of the ink tank coupling member 90, and wings 93 are formed in the back surface thereof. Further, the wall thickness of the ink tank coupling member 90 varies with a thick wall region 95 being thicker than a thin wall region 94 and protruding to a given height (0.7 mm in this embodiment). A slit 96 is formed in the front surface of the ink tank coupling member 90. A mounting in fallen down state preventing sheet 34 (refer to FIG. 3) that projects from the holder 30 in a flat sheet shape is inserted into the slit 96. The slit 96 is loosely fitted to the mounting in fallen down state preventing sheet 34 in a process for mounting the ink tank module 205 on the holder 30 to prevent the ink tank module 205 from inclining and the rear end 15 from being insufficiently fitted to the holder 30.

Figure 10B:
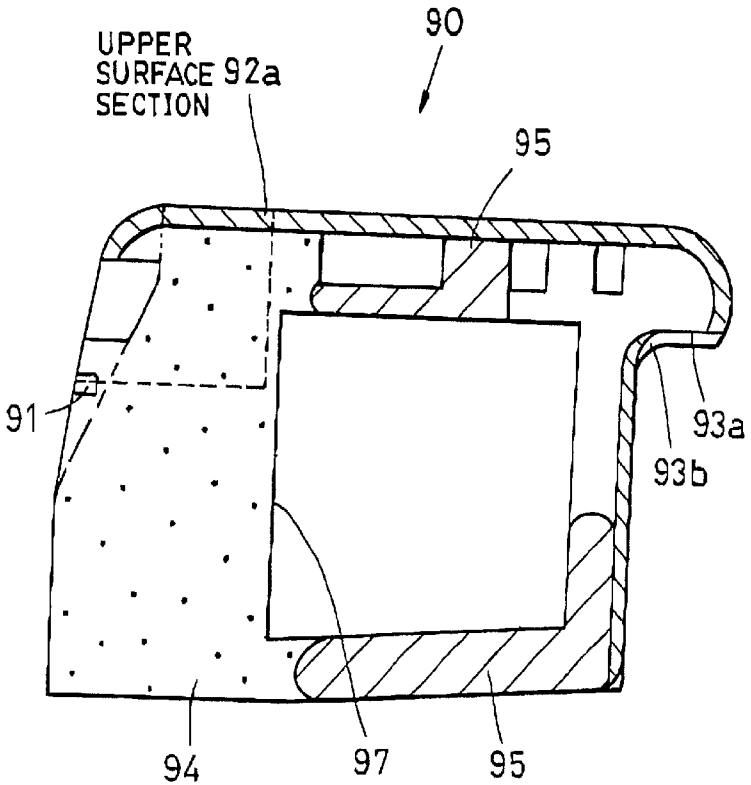
FIG. 10B is a side elevational view of the ink tank coupling member.
Figure 10A:
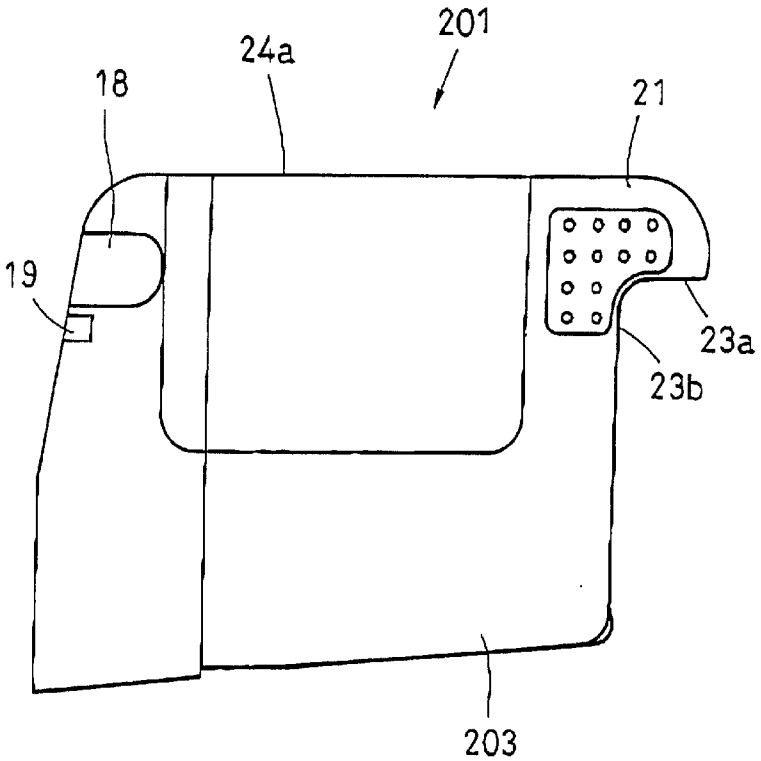
FIG. 10A is a side elevational view of the standard ink tank.
Figure 11:
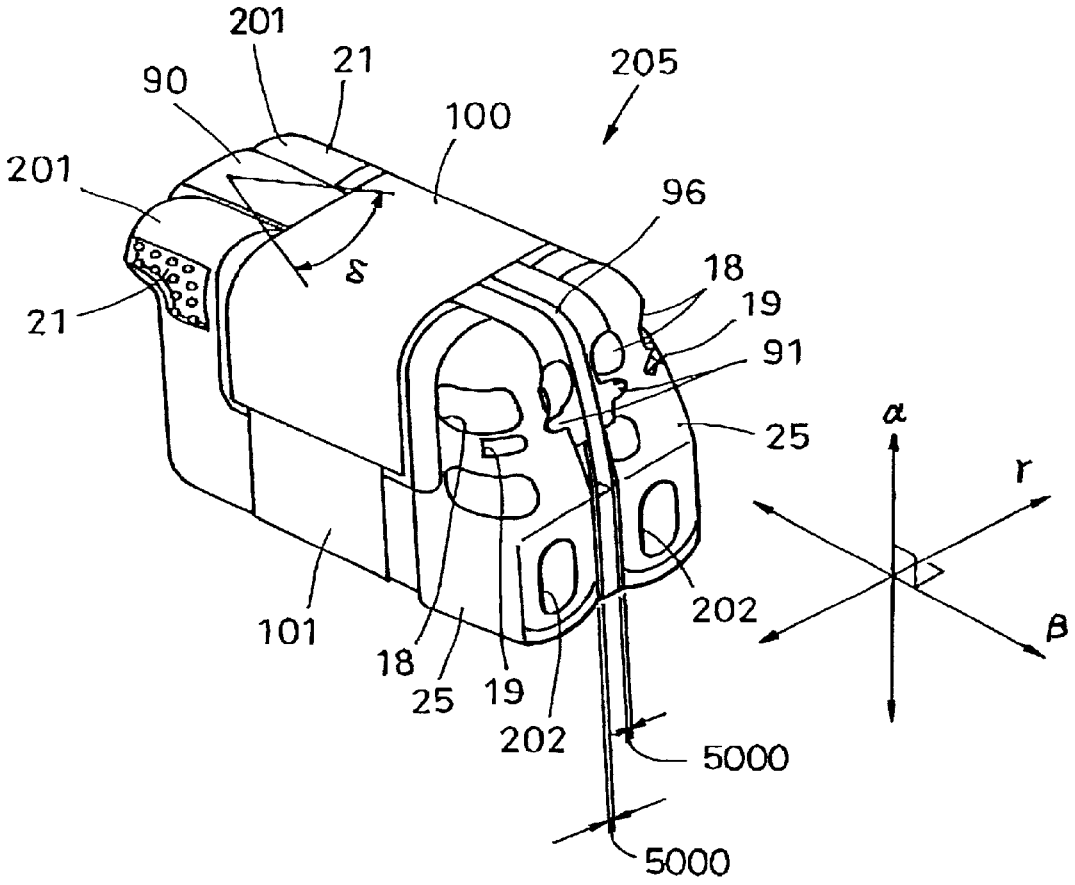
FIG. 11 is a perspective view of the ink tank module.

FIGS. 10A and 10B are side elevational views of the standard ink tank 201 and the ink tank coupling member 90. FIG. 11 is a perspective view of the ink tank module 205 (large capacity tank) in which two standard ink tanks 201 are disposed on both sides of the ink tank coupling member 90 and integrated together (arranged as a module).

The engaging recesses 19 of the standard ink tank 201 can be engaged with the engaging projections 91 of the ink tank coupling member 90. The grip sections 21 of the standard ink tank 201 can be located on the wings 93 of the ink tank coupling member 90. To describe this in more detail, grip sections 23*a* of the standard ink tank 201 are in contact with wings 93*a* of the ink tank coupling member 90, and grip sections 23*b* of the standard ink tank 201 are in contact with wings 93*b* of the ink tank coupling member 90. The maximum area surfaces (sides) 203 of the standard ink tanks 201 are abutted against the thick wall region 95 of the ink tank coupling member 90. The standard ink tanks 201 and the ink tank coupling member 90 are wrapped with and tightened together by an annular uniaxial oriented thermal contraction PET (polyethylene telephthalate) film 101 (refer to FIG. 11) so as to cover the abutted regions, whereby the two standard ink tanks 201 are coupled with and fixed to the ink tank coupling member 90. The label 100 is stuck so as to extend over the annular uniaxial oriented thermal contraction PET film 101, the standard ink tanks 201, and the ink tank coupling member 90, thereby preventing the removal of the annular uniaxial oriented thermal contraction PET film 101.

As described above, a plurality of the standard ink tanks 201 are coupled and fixed together by the ink tank coupling member 90 so as to arrange the ink tank module 205 as shown in FIG. 11. Specifically, the upper surfaces 24*a* of the standard ink tanks 201 are abutted against the upper surface section 92*a* of the ink tank coupling member 90, which extends to both sides thereof. Additionally, the engaging recesses 19 are engaged with the engaging projections 33 and the grip sections 23*a* of the standard ink tanks 201 are abutted against the wings 93*a*. Accordingly, the upward movement of the standard ink tanks 201 ($\alpha$ direction shown in FIG. 11) is prevented. Further, the standard ink tanks 201 are tightened together by the annular uniaxial oriented thermal contraction PET film 101 so as not to move in a right and left direction ($\gamma$ direction in FIG. 1).

The standard ink tanks 201 are moveable in a $\delta$ direction, as shown in FIG. 11, because sides 203 of the standard ink tanks 201 are not in contact with the thin wall region 94 of the ink tank coupling member 90 and the rigidity of the annular uniaxial oriented thermal contraction PET film 101 is not high. With this arrangement, even if the pitch of the two supply ports 202 of the standard ink tanks 201 in the right and left direction ($\gamma$ direction in FIG. 11) varies from the pitch of the joint 51 of the holder 30 by the dimensional tolerance of the joint 51 of the holder 30 in the pitch direction thereof or by dimensional errors of the standard ink tanks 201 and the ink tank coupling member 90, the standard ink tanks 201 are moveable so as to widen or narrow the pitch of the supply ports 202. As a result, the standard ink tanks 201 can be moved in a direction where any variation between the pitch of the supply ports 202 and the pitch of the joint 51 can be absorbed when the ink tank module 205 is mounted on the holder 30. This is because the standard ink tanks 201 are not fixed in the vicinity of the supply ports 202 in the ink tank module 205 as well as the existence of clearances 5000, which allows movement of the standard ink tanks. Accordingly, even if there is a variance as large as ±0.5 mm (in this embodiment) between both the pitches, the pitch of the supply ports 202 can be adjusted according to the pitch of the joint 51 without moving the rear end of the ink tank module 205. In particular, in the arrangement in which the standard ink tank 201 directly accommodates ink and is hermetically sealed by the valve 14, the ink tank module 205 can be mounted and dismounted while absorbing the positional error between the ink tank module 205 and the joint 51 on the holder 30, which can effectively prevent the leakage of the ink.

In this embodiment, the black ink is accommodated by the provision of the ink tank module 205, which is constructed by bundling the two of the standard ink tanks 201 together using the ink tank coupling member 90. However, the number of the ink tank modules 205, the color of the ink accommodated therein, and the number of the standard ink tanks 201 constructing one ink tank module 205 is not limited to the aforementioned example and may vary depending on the design or use. The ink tank coupling member 90 of this embodiment may be used in the number which corresponds to the number of the standard ink tanks 201 to be coupled together. Further, as a modification, the gist of the present invention may be realized by a structure in which a plurality of the coupling members are substantially integrated.

[Second embodiment]

Next, a second embodiment of the present invention will be described with reference to FIG. 12. Note that the arrangements in the second embodiment which are similar to those of the first embodiment will be denoted by the same reference numerals, and the description thereof is omitted.

Figure 12:
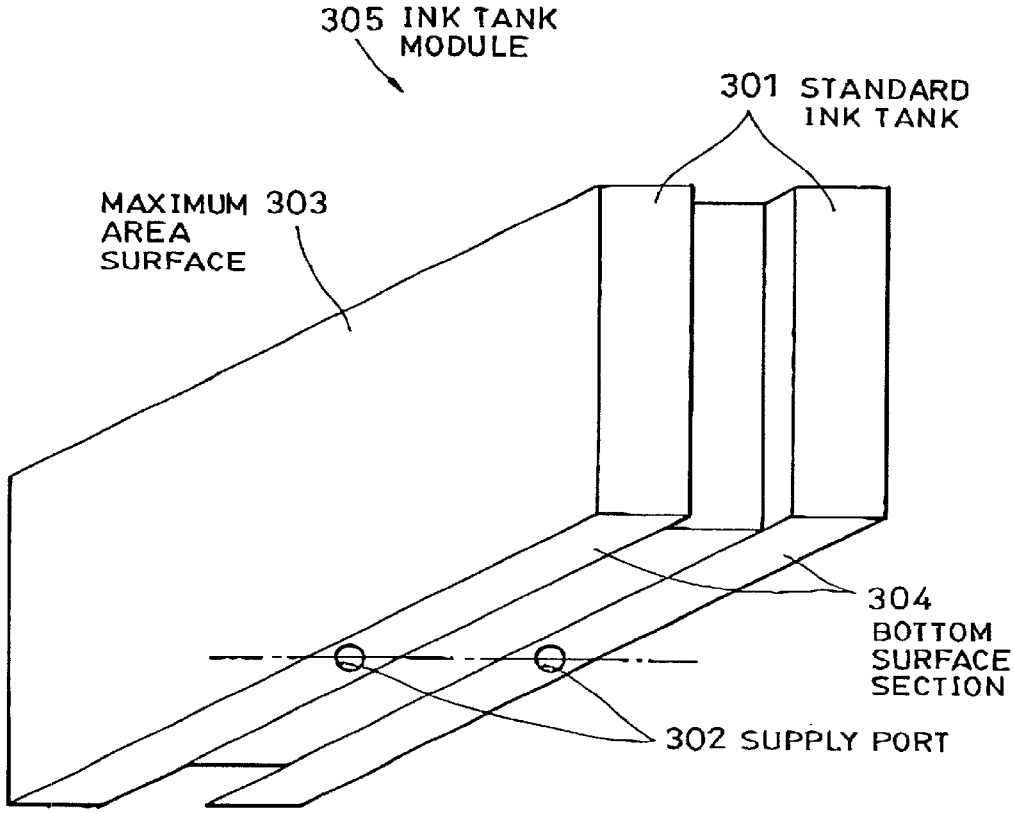
FIG. 12 is a schematic view of the ink tank module of a second embodiment.

FIG. 12 shows a schematic view of an ink tank module 305 of the second embodiment. In the second embodiment, a standard ink tank 301 has a supply port 302 formed through a bottom surface section 304 sandwiched between a pair of confronting maximum area surfaces 303 and can be mounted and dismounted to and from the holder 30 in an up and down direction. The supply ports 302 of the two standard ink tanks 301 constituting the ink tank module 305 are disposed on a straight line.

[Third embodiment]

Next, a third embodiment of the present invention will be described with reference to FIG. 13. Note that the arrangements of the third embodiment similar to those of the first and second embodiments will be denoted by the same reference numerals, and the description thereof is omitted.

Figure 13:
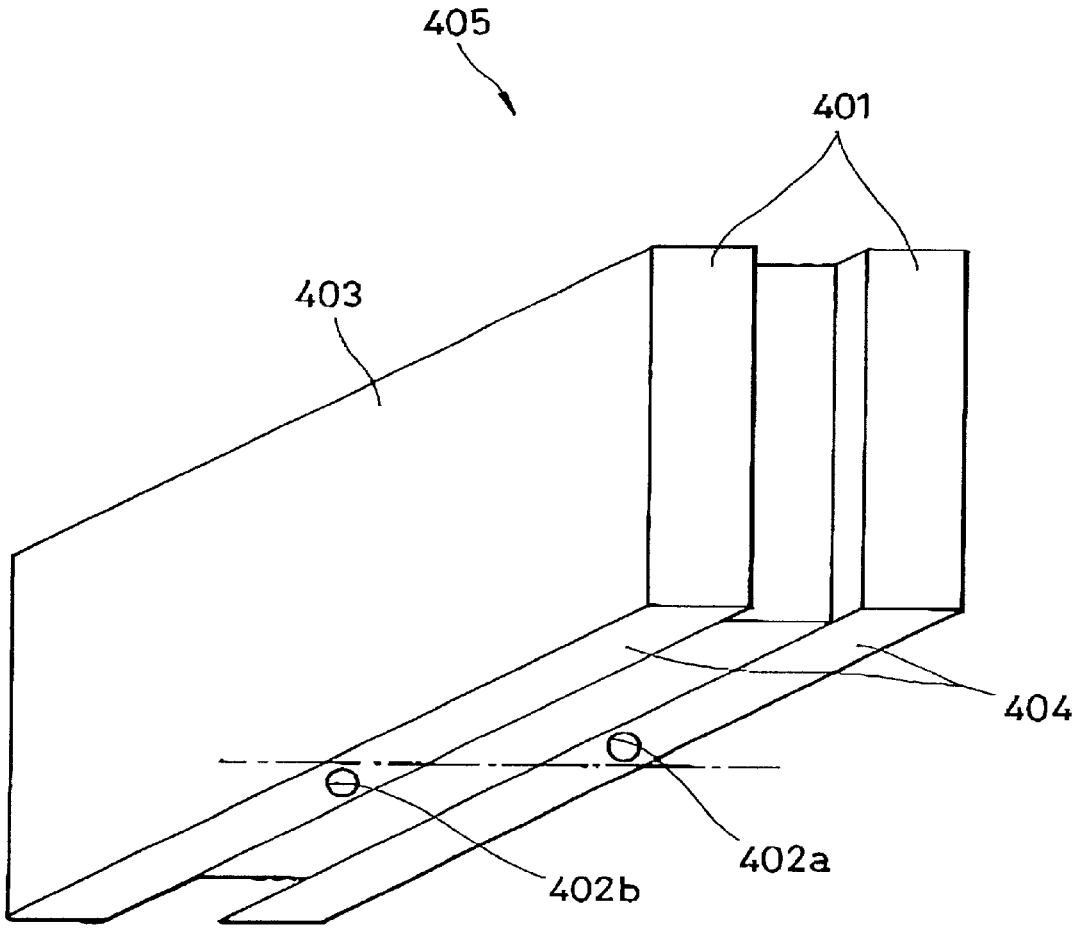
FIG. 13 is a schematic view of the ink tank module of a third embodiment.

FIG. 13 shows a schematic view of an ink tank module 405 of the fourth embodiment. In this embodiment, standard ink tanks 401 have supply ports 402*a* and 402*b* each disposed at a position somewhat dislocated from the center of a bottom surface section 404 sandwiched between a pair of confronting maximum area surfaces 403 and mounted and dismounted to and from the holder 30 in an up and down direction. However, one of the two standard ink tanks 401 constituting the ink tank module 405 is coupled with the other ink tank in the state in which it is rotated 180° about an axis passing through the supply port thereof. Accordingly, the supply ports 402*a* and 402*b* are not disposed on a straight line, that is, one supply port 402*a* is disposed forward of a center and the other supply port 402*b* is disposed rearward thereof.

[Fourth embodiment]

Next, a fourth embodiment of the present invention will be described with reference to FIG. 14. Note that the arrangements of the fourth embodiment similar to those of the first to third embodiments will be denoted by the same reference numerals, and the description thereof is omitted.

Figure 14:
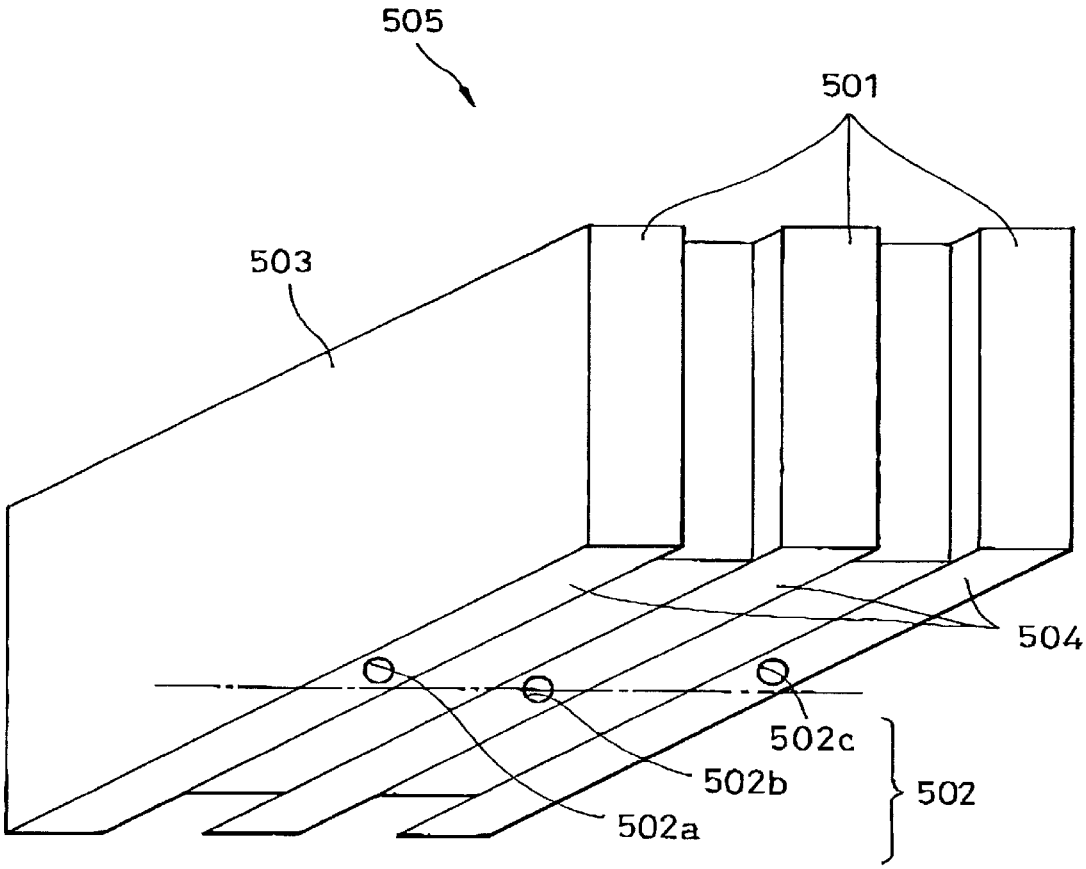
FIG. 14 is a schematic view of the ink tank module of a fourth embodiment.

FIG. 14 shows a schematic view of an ink tank module 505 of the fourth embodiment. In this embodiment, the ink tank module 505 is composed of three sets of standard ink tanks 501 coupled together, and each of the supply ports 502*a*, 502*b*, and 502*c* of the standard ink tanks 501 is formed through a bottom surface section 504 sandwiched between a pair of confronting maximum area surfaces 503. This embodiment is a further modification of the third embodiment. In the fourth embodiment, three standard ink tanks 501 are coupled together in a staggered configuration by being rotated 180°. Thus, the supply ports 502*a*, 502*b*, and 502*c* are not always disposed on a straight line and may be dislocated forward and rearward as shown in FIG. 14 for the convenience of design of the recording head and the holder, and the like.

It is needless to say that even an ink tank module, which is composed of at least three standard ink tanks as described above, achieves the effect of the present invention. In this case, it is preferable to arrange the standard ink tanks 501 and the supply ports 502 at approximately the same pitch because the holder 30 can be easily designed and the common ink tank coupling member 90 can be used thereby. Further, various types of ink tank modules may be arranged by providing, for example, two types of the standard ink tanks and combining the arrangements of FIGS. 12 and 13.

Figure 15:
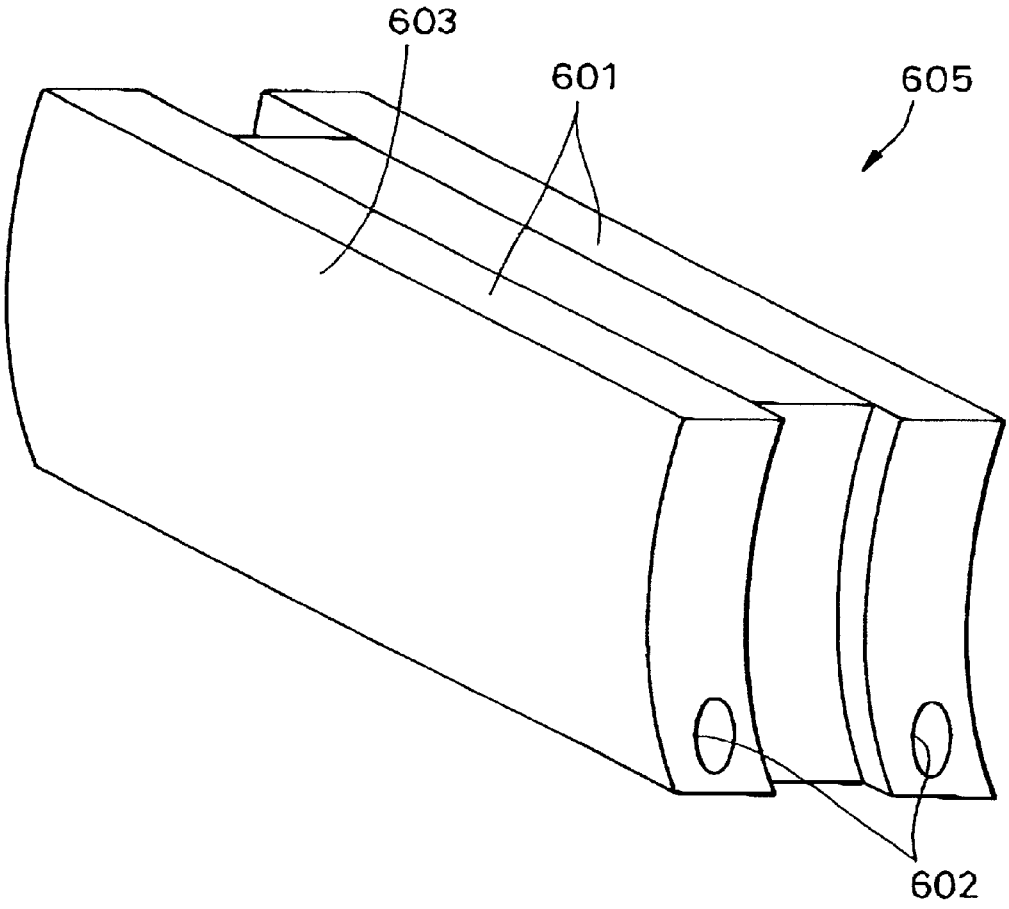
FIG. 15 is a schematic view of a modification of the ink tank module.

Further, as shown in FIG. 15, an ink tank module 605 may be composed of standard ink tanks 601 each formed in a rectangular prism shape with curved surfaces. It is more preferable that the pair of confronting maximum area surface 603 of each standard ink tank 601 be symmetrical with respect to a surface through which a supply port 602 is formed.

Note that while the holder 30 described in the first embodiment includes the absorption member chamber 50, the present invention is by no means limited to this arrangement and any arrangement may be employed as long as a joint is provided in correspondence to the supply port of each standard ink tank.

As described above, since the large capacity ink tank is arranged using standard ink tanks, it is not necessary to design and evaluate multiple types of ink tanks. Accordingly, ink tanks can be easily manufactured and the cost thereof can be reduced. Since an ink tank module, in which a plurality of the standard ink tanks are coupled together, is used for the color of ink with the quickest rate of consumption, a sufficient amount of ink can be stored in ink tank module.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink tank module comprising;

a plurality of ink tanks, each of said plurality of ink tanks having substantially the same outside shape and including an ink accommodating section for accommodating ink and a supply port for supplying ink to an inkjet recording head;

a coupling member interposed between said plurality of ink tanks; and an annular film member for covering said plurality of ink tanks and said coupling member thereby coupling said plurality of ink tanks and said coupling member together, wherein said plurality of ink tanks are arranged so that the supply port for each of said plurality of ink tanks is disposed in the same direction and wherein said ink tank module is detachably mountable to a holder on which the inkjet recording head is mounted.

2. An ink tank module according to claim 1, wherein each of said plurality of ink tanks is a hermetically sealed vessel having a rectangular shape comprising a plurality of small surface areas disposed between two opposing large surface areas and wherein the supply port is disposed in one of the plurality of small surface areas.

3. An ink tank module according to claim 1, wherein at least three ink tanks are coupled together and the supply ports of said ink tanks are disposed with equal spacing between the supply ports.

4. An ink tank module according to claim 2, wherein said coupling member holds said plurality of ink tanks by abutting against the large surface areas of said plurality of ink tanks in a first section of the large surface areas opposite a second section of the large surface areas, the second section being near where the supply ports are disposed.

5. An ink tank module according to claim 1, wherein said plurality of ink tanks are arranged so that the supply ports are disposed in a straight line.

6. An ink tank module according to claim 1, further comprising an adhesive label placed on said plurality of ink tanks, said coupling member and said annular film member, said adhesive label for limiting movement and deformation of said annular film member.

7. An ink tank module according to claim 1, wherein each of said plurality of ink tanks includes a first engaging section disposed in an upper portion of the small surface area in which the supply port is disposed and said coupling member includes a second engaging section corresponding to the first engaging section, wherein the first and second engaging sections meet when said plurality of ink tanks are coupled with said coupling member.

8. An ink tank coupling member for coupling together a plurality of ink tanks to form an ink tank module, the ink tank module detachably mountable to a holder on which an inkjet recording head is mounted, said ink tank coupling member comprising:

a separating wall comprising a thick wall region and a thin wall region, wherein the plurality of ink tanks abut against the thick wall region of said separating wall when the plurality of ink tanks are coupled together with said ink tank coupling member; and a plurality of engaging sections which engage with corresponding second engaging sections of the plurality of ink tanks, wherein each of the plurality of ink tanks coupled together with said ink tank coupling member include a supply port and the supply ports are arranged at a pitch equal to a joint pitch of the holder.

9. An ink tank coupling member according to claim 8, the ink tank coupling member further comprising a slit formed within said separating wall into which a projection projecting from the holder is received when the ink tank module is mounted to the holder.

10. An inkjet recording apparatus comprising:

a holder having an inkjet recording head mounted thereon for ejecting ink;

an ink tank module according to claim 1; and a plurality of ink tanks, wherein said holder includes a plurality of mounting sections for detachably mounting said ink tank module and said plurality of ink tanks.

11. An inkjet recording apparatus according to claim 10, wherein said ink tank module and said plurality of ink tanks each accommodate one of a plurality of ink types.

12. An inkjet recording apparatus according to claim 11, wherein said ink tank module accommodates black ink and said plurality of ink tanks accommodate a plurality of color inks.

* * * * *

UNITED STATES PATENT AND TRADEMARK OFFICE

CERTIFICATE OF CORRECTION

PATENT NO. : 6,402,298 B1
DATED : June 11, 2002
INVENTOR(S) : Tatsuo Nanjo et al.

It is certified that error appears in the above-identified patent and that said Letters Patent is hereby corrected as shown below:

Column 1,
Line 65, “tank” should read -- tanks --; and
Line 66, “use’s” should read -- user’s --.

Column 2,
Line 5, “point of view users” should read -- user’s point of view --.

Column 6,
Line 26, “telephthalate)” should read -- terephthalate) --; and
Line 49, “FIG. 1).” should read -- FIG. 11). --.

Signed and Sealed this

Third Day of December, 2002

JAMES E. ROGAN
*Director of the United States Patent and Trademark Office*